United States Patent [19]

Tlach et al.

[11] 4,200,489

[45] Apr. 29, 1980

[54] PROCESS FOR PRODUCING SIZED PAPER OR CARDBOARD WITH DYES OR OPTICAL BRIGHTENERS AND EPOXIDE-AMINE-POLYAMIDE REACTION PRODUCTS

[75] Inventors: Hugo Tlach, Basel; Klaus-Dieter Leifels, Binningen; Werner Mischler, Burg, all of Switzerland

[73] Assignee: Ciba-Geigy Corporation, Ardsley, N.Y.

[21] Appl. No.: 933,688

[22] Filed: Aug. 15, 1978

[30] Foreign Application Priority Data

Aug. 26, 1977 [CH] Switzerland ..... 10456/77

[51] Int. Cl.[2] ..... D21H 3/58

[52] U.S. Cl. ..... 162/162; 162/164 EP

[58] Field of Search ..... 162/162, 164 EP

[56] References Cited

U.S. PATENT DOCUMENTS

| | | | |
|---|---|---|---|
| 3,709,847 | 1/1973 | Toepfl et al. | 260/18 PN |
| 4,014,870 | 3/1977 | Meyer | 162/162 |
| 4,023,924 | 5/1977 | Frei et al. | 162/162 |

*Primary Examiner*—S. Leon Bashore
*Assistant Examiner*—William F. Smith
*Attorney, Agent, or Firm*—Edward McC. Roberts

[57] ABSTRACT

A process for producing paper or cardboard which is sized in the pulp with epoxide-amine-polyamide reaction products is disclosed.

In this process there are added to the fibre suspension (A) at least one water-soluble, anionic, substantive direct dye and/or optical brightener, followed by (B) at least one water-soluble or water-dispersible salt of an epoxide-amine-polyamide reaction product, whereupon the fibre suspension is further processed into paper or into cardboard.

10 Claims, No Drawings

PROCESS FOR PRODUCING SIZED PAPER OR CARDBOARD WITH DYES OR OPTICAL BRIGHTENERS AND EPOXIDE-AMINE-POLYAMIDE REACTION PRODUCTS

The invention relates to a process for producing paper or cardboard which is sized in the pulp with epoxide-amine-polyamide reaction products, which process comprises adding to the fibre suspension (A) at least one water-soluble, anionic, substantive direct dye and/or an optical brightener, followed by (B) at least one water-soluble or water-dispersible salt of an epoxide-amide-polyamide reaction product, and further processing the fibre suspension into paper or into cardboard.

It has been found therefore that, with the addition of epoxide-amine-polyamide reaction products, an addition of anionic dyes or brighteners made before the addition of the reaction product results in a surprising synergistic enhancement of the sizing effects of the epoxide-amine-polyamide reaction product in the paper-making process, and in this way are obtained sized papers having for example correspondingly lower water absorption values according to Cobb, and longer ink flotation times.

The dyes of the stated type, which are used in the process according to the invention as component (A), are described, inter alia, in the textbook entitled "Künstliche organische Farbstoffe und ihre Zwischenprodukte" (Synthetic organic Dyes and Intermediates thereof) by H.R. Schweizer, Springer Verlag Berlin (1964), pages 481 to 495. Suitable dyes among those described are in particular azo dyes, especially disazo or trisazo dyes, which contain water-solubilising anionic sulfonic acid groups. The triazinyl dyes are in this respect of particular importance.

Optical brighteners which can likewise be used as component (A) in the process according to the invention belong in general to the styryl and stilbene series, particularly to the class comprising distyrylarylenes, diaminostilbenes, ditriazolylstilbenes, phenylbenzoxazolylstilbenes, stilbenenaphthotriazoles and dibenzoxazolylstilbenes. Foremost of interest in this connection are optical brighteners of the distyrylbiphenyl class or of the bistriazinylaminostilbene class, which contain water-solubilising anionic sulfonic acid groups, especially bis-(phenylamino-dialkylamino-s-triazinyl)-stilbenedisulfonic acids and bis-(phenylaminomorpholino-s-triazinyl)-stilbenedisulfonic acids.

In the process according to the invention, there is as a rule added to the fibre suspension 0.01 to 1, preferably 0.02 to 1, especially 0.08 to 0.7, percent by weight of the aforementioned dyes or optical brighteners as component (A), calculated as anhydrous and undiluted dye or brightener relative to the dry-fibre content of the fibre suspension.

As preferred component (B) are used salts of expoxide-amine-polyamide reaction products from (a) 1.0 epoxide group equivalent of a polyglycidyl ether of 2,2-bis-(4' -hydroxyphenyl)-propane, (b) 0.4 to 0.6 amino group equivalent of at least one mono-fatty amine having 16 to 18 carbon atoms, and (c) 0.3 to 0.5 amino group equivalent of a polyalkyleneaminopolyamide from c' polymerised linoleic acid and/or linolenic acid, and c'' diethylenetriamine, triethylenetetramine or tetraethylenepentamine, and these salts of the reaction products are in the form of aqueous preparations having a solids content of 25 to 35 per cent by weight, and a pH value of 4 to 5.

There are used as component (B) in particular salts of epoxide-amine-polyamide reaction products, which are produced in the presence of at least one solvent chemically inert to the components (a), (b) and (c). Suitable inert solvents are, inter alia, the following solvents, which are soluble with water in any proportion: aliphatic ethers or especially alcohols having 1 to 10 carbon atoms, such as dioxane, methylene glycol-n-butyl ether (= n-butyl glycol), diethylene glycol monobutyl ether and alkanols having 1 to 4 carbon atoms, especially isopropanol, ethanol or methanol.

The salts of component (B) are preferably used as aqueous preparations, the pH value of which is 4 to 5, particularly 4 to 4.5, and the pH is adjusted to this value with inorganic or, in particular, organic acids that are preferably volatile. These are especially alkanecarboxylic acids having 1 to 4, preferably 1 or 2, carbon atoms, i.e. formic acid and particularly acetic acid.

The epoxide-amine-polyamide reaction products used as component (B) in the process according to the invention are preferably produced from a polyglycidyl ether as component (a), which has a preferred epoxide content of 5 to 5.5 equivalents per kg, a mono-fatty amine as component (b) and a polyalkyleneaminopolyamide as component (c), each of (b) and (c) having preferred amino group contents of 3 to 4 equivalents per kg. Especially suitable components (B) are salts of reaction products, which salts are produced from an adduct of epichlorohydrin and 2,2-bis-(4' -hydroxyphenyl)-propane as component (a), tallow fatty amine as component (b) and a polyamide from dimerised linoleic acid as component (c') and triethylenetetramine as component (c'').

The salts of epoxide-amine-polyamide reaction products, which salts are used as component (B) in the process according to the invention, are described, inter alia, in the Swiss Pat. Application No. 15764/76 or in the British Pat. specification No. 1,300,505.

In the process according to the invention is added to the fibre suspension as a rule 0.05 to 3, preferably 0.2 to 0.8, particularly 0.4 to 0.8 , percent by weight of component (B), calculated as anhydrous salt of the epoxide-amine-polyamide reaction product, relative to the dry-fibre content of the fibre suspension.

There is firstly added to the fibre suspension in the process according to the invention the component (A) and secondly the component (B), the addition of the component (A) being made preferably 20 to 120, especially 30 to 40, minutes before the suspension reaches the breastbox of the paper machine, and the addition of the component (B) being made preferably 3 to 300, preferably 10 to 120, particularly 5 to 45, seconds before the suspension reaches the breastbox of the paper machine.

The fibre suspension, to which the components (A) and (B) are added, is generally neutral to weakly alkaline or weakly acid; as a rule it has a pH value of 6 to 8 or of 7 to 8, dry-fibre content of 0.1 to 4.5, preferably 0.6 to 1.5, especially 0.2 to 1.2, per cent by weight, and a Schopper-Riegler freeness value of 20° to 60°, preferably 30° to 50°, in particular 25 to 35°, and contains as a rule sulfite pulp, preferably sulfite pulp from the wood of conifers, sulfate pulp, preferably sulfat pulp from beechwood, and optionally mechanical wood pulp.

The fibre suspension can also contain organic or mineral fillers. Suitable organic fillers are, inter alia, synthetic pigments, for example polycondensation products from urea or melamine and formaldehyde which have large specific surface areas, which are in a highly dispersed form and which are described, inter alia, in the British Pat. specifications Nos. 1,043,937 and 1,318,244; and suitable mineral fillers are, inter alia, talcum, titanium dioxide and, in particular, kaolinand-/or calcium carbonate. The fibre suspension contains as a rule 0 to 40, preferably 5 to 15, percent by weight, relative to the dry-fibre content, or fillers of the type mentioned.

With the addition of for example calcium carbonate, weakly alkaline fibre suspensions are in general obtained, whereas with the addition of for example kaolin, weakly acid fibre suspensions are generally obtained.

In the process according to the invention, the fibre suspension is further processed, in a manner known per se, on sheet-forming apparatus, or preferably continuously on paper machines of customary design, into the form of paper or cardboard. Paper or cardboard produced by the process according to the invention thus constitutes further subject matter of the present invention.

Parts and percentages given in the following manufacturing instructions and practical examples are part by weight and percentages by weight.

Manufacturing instructions for salts of epoxide-amine-polyamide reaction products [Component (B)]

A 190 parts (1 epoxide equivalent ) of an epoxide (epoxide number: 5.26 equivalents /kg) formed from 2,2-bis-(4' -hydroxyphenyl)-propane and epichlorohydrin, 68 parts of methanol and 108 parts of stearylamine (0.4 amino group equivalent) are heated to an internal temperature of 68° C., and held for 15 minutes at this temperature. To this solution is added, within 30 minutes, a solution of 125 parts (0.5 amino group equivalent) of a polyamide from dimerised linoleic acid and diethylenetriamine in 125 parts of methanol. After five hours' reaction at 65° C., there is added to the reaction mixture a solution of 75 parts of acetic acid in 250 parts of water. The result is a clear solution which is diluted with water to give a solids content of 30%. The pH value of the diluted solution is 4.5.

B. 135 parts (0.5 amino group equivalent) of tallow-fatty amine (30% of $C_{16}H_{33}NH_2$, 30% of $C_{18}H_{37}NH_2$, 40% of $C_{18}H_{35}NH_2$; amine number: 3.7 equivalents/kg) and 38 parts of isopropanol are heated to 85° C. To this solution is then added at 85° C. a solution of 190 parts (1 epoxide group equivalent) of an epoxide (epoxide number: 5.26 equivalents/kg), formed from 2,2-bis-(4' -hydroxyphenyl)-propane and epichlorohydrin, in 38 parts of isopropanol. The reaction mixture is held at 85° C. for 15 minutes to thus obtain a clear 81% solution of which the amine-epoxide reaction product has an epoxide group equivalent weight of 3120.

To this reaction solution is added a solution of 108 parts (0.432 amino group equivalent ) of a polyamide from dimerised linoleic acid and triethylenetetramine in 38 parts of isopropanol. After two hours' reaction at 85° C., there is added to the reaction mixture a solution of 72 parts of acetic acid in 227 parts of water. There is obtained a clear solution which is distilled with water to give a solids content of 30%. The pH value of the diluted solution is 4.

C. 135 parts (0.5 amino group equivalent) of stearylamine and 40 parts of ethylene glycol monobutyl ether are heated to 80° C. There is then added a solution of 190 parts (1 epoxide group equivalent) of an epoxide (epoxide number: 5.26 equivalents/kg), which is formed from 2,2-bis-(4'-hydroxyphenyl)-propane and epichlorohydrin, in 40 parts of ethylene glycol monobutyl ether at 80° C. The reaction mixture is held at 85° C. for 15 minutes. To this reaction solution is added a solution of 125 parts (0.5 amino group equivalent) of a polyamide from dimerised linoleic acid and triethylenetetramine in 100 parts of ethylene glycol monobutyl ether. After a reaction time of two hours at 85° C., there is added to the reaction mixture a solution of 83 parts of acetic acid in 230 parts of water. The clear solution obtained is diluted with water to give a solids content of 30%. The pH value of the diluted solution is 4.6.

EXAMPLE 1

To a fibre suspension formed from

50% of bleached sulfite pulp from the wood of conifers,

50% of bleached sulfate pulp from beechwood, which has a Schopper-Riegler freeness value of 32°, is added, in a mixing vat, 10% of precipitated calcium carbonate as a 30% aqueous suspension. The pH value established in the fibre suspension after the addition of calcium carbonate is 7.4 to 7.5. The fibre suspension is continously diluted with water to give a dry-fibre content of 1.2%. To the fibre suspension are subsequently added, 30 minutes before the suspension reaches the breastbox of the paper machine, the amounts of dyes or optical brighteners given in the following Table I. There are then continuously added to the fibre suspension 25 seconds before its reached the breastbox 0.43% of the salts (listed in the following Table) of the epoxide-amine-polyamide reaction product in the form of a 0.33% aqueous solution. The amounts of dyes and of optical brighteners, which are given as percentage amounts in the following Table I, are with respect to % amounts of pure substance (i.e. without dilution) relative to the dry-fibre weight of the fibre suspension. The same applies also to the aforesaid percentage amounts of anhydrous calcium carbonate and to the percentage amounts of anhydrous salts of the epoxide-amine-polyamide reaction products, which are given in the Table I which follows.

The fibre suspension is processed in a laboratory paper-making machine, with a constant setting of the machine, into a paper having a weight per unit area of $75 \pm 2 g/m^2$. The paper is dried in the machine to the extent that the paper has a residual moisture content of 5%. The paper sheets obtained are conditioned for 24 hours with 65% relative humidity, and then tested to determine their water absorption, according to Cobb, after 30 seconds' duration of action (WA $Cobb_{30}$) according to DIN 53132. The less the absorption of water, the better the sizing of the paper.

The results of the WA $Cobb_{30}$ test are likewise summarized in the following Table I. For purposes of comparison, there are also given in the Table the results of the WA $Cobb_{30}$ test on a paper which had been produced from a dye suspension containing merely the salt of the epoxide-amine-polyamide reaction product.

Table I

| Example No. | Designation of component (A) | Amount of component (A) % | Designation of component (B) | Amount of component (B) % | WA $Cobb_{30}$ $g/m^2$ |
|---|---|---|---|---|---|
| 1a | dye of the formula (1)* | 0.08 | salt according to instruction B | 0.43 | 22 |
| 1b | dye of the formula (2)* | 0.15 | salt according to instruction B | 0.43 | 30 |
| 1c | dye according to C.I. No. 29160 | 0.13 | salt according to instruction A | 0.43 | 21 |
| 1d | optical brightener of the formula (3)* | 0.08 | salt according to instruction C | 0.43 | 30 |
| (comparison) | — | 0 | salt according to instruction B | 0.43 | 60 |

*(see formulae below)

Similar results are obtained with the dyes given in the Colour Index (3rd Edition, 1971) in the chapter headed "Direct Dyes".

EXAMPLE 2

A fibre suspension of 50% of bleached sulfite pulp from the wood of conifers, 25% of bleached sulfate pulp from beechwood and 25% of mechanical wood pulp is ground to give a Schopper-Riegler freeness value of 48°; to the suspension is then added in a mixing vat 50% of kaolin in the form of an 18% aqueous suspension. The suspension is continuously diluted with water to obtain a dry-fibre content of 0.2%. The pH value of the diluted suspension is 6.3.

To the fibre suspension are added continuously, 30 minutes before the suspension reaches the breastbox of the paper machine, the amounts, given in the following Table II (as percentage amounts of pure substance relative to the dry-fibre content of the suspension), of optical brighteners as 1% solutions, and then 30 seconds before reaching the breastbox of the paper machine 0.6% (as percentage amount of pure substance relative to the dry-fibre content of the suspension) of salt of the epoxide-amine-polyamide reaction product, according to instruction B as a 0.3% aqueous solution.

The fibre suspension is subsequently processed, as described in Example 1, into paper and this is then conditioned. The results of the WA $Cobb_{30}$ test, likewise mentioned in Example 1, are summarised in the following Table II. Furthermore, the ink flotation time (IFT) of the conditioned paper obtained is tested with test ink according to DIN 53126 using the following method.

Paper test ink "blue", according to DIN 53126, is poured into a 10×12 cm porcelain dish until the level of the ink has reached 0.5 cm. The paper to be tested is folded to form little boats having an upright edge (size 4×4cm). The boats are placed by means of tweezers onto the surface of the ink. A stop watch is released simultaneously and the time until a visible strike-through of the test ink occurs is measured. The results are recorded in seconds.

In the case of untreated paper, the strike-through of the ink occurs immediately. The longer the test ink takes to strike through the sized paper, the better is the sizing.

The results of the IFT test are likewise summarised in the Table II which follows.

Table II

| Example No. | Designation of component A | Amount of component A % | Designation of component B | Amount of component B % | WA $Cobb_{30}$ $g/m^2$ | IFT seconds |
|---|---|---|---|---|---|---|
| 2a | optical | 0.1 | salt | 0.6 | 20.5 | 1600 |
| 2b | brightener of | 0.2 | according to | 0.6 | 17.0 | 1660 |
| 2c | the formula | 0.4 | instruction | 0.6 | 18.5 | 1630 |
| 2d | (4)* | 0.7 | B | 0.6 | 20.0 | 1660 |
| 2e | optical | 0.1 | salt | 0.6 | 20.5 | 1660 |
| 2f | brightener of | 0.2 | according to | 0.6 | 20.5 | 1630 |
| 2g | the formula | 0.4 | instruction | 0.6 | 19.5 | 1645 |
| 2h | (3)* | 0.7 | B | 0.6 | 20.0 | 1570 |
| (comparison) | — | 0 | salt according to instruction B | 0.6 | 41.5 | 1255 |

* (see formulae below)

Similar results are obtained with the other optical brighteners of the 4,4'-bis-(triazinylamino)-stilbene-2,2'-disulfonic acid class, and the class comprising 4,4'-distyryl-biphenyls, which are suitable for use in the paper industry and which are given in the CIBA-GEIGY Rundschau 1973/1, page 8.

Formulae

Table II-continued (1)

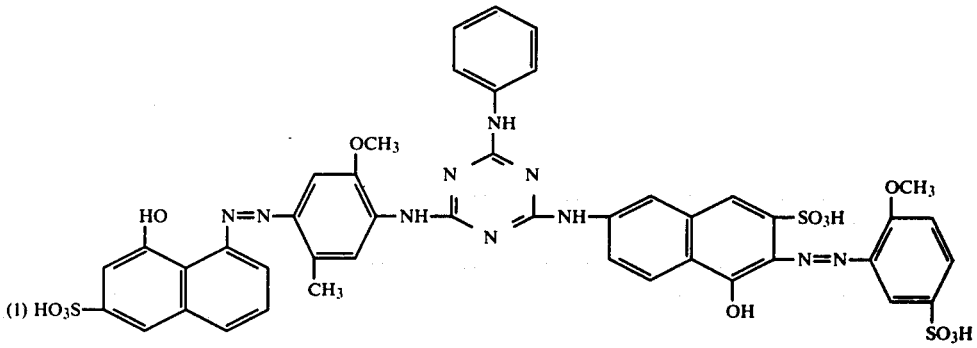

(2)

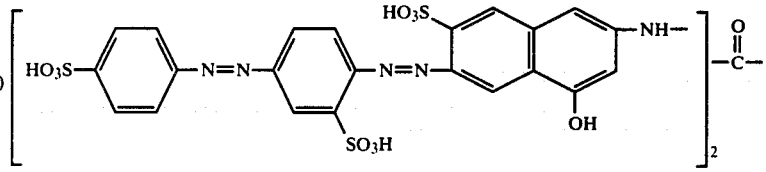

(3)

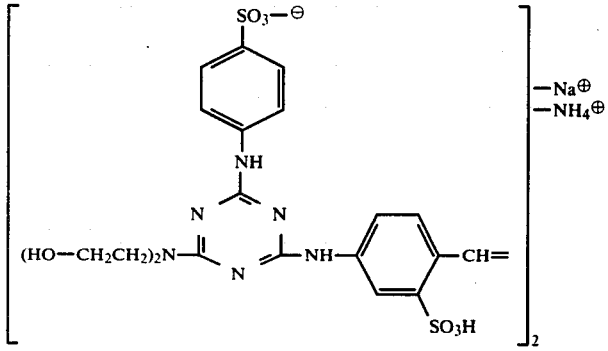

(4)

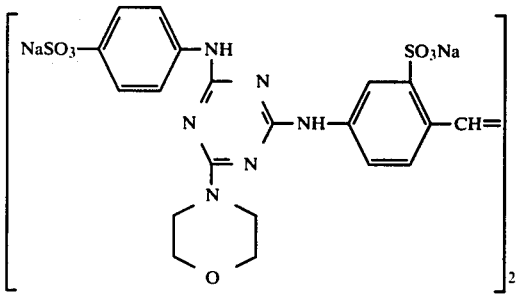

We claim:

1. A process for producing paper or cardboard which is sized in the pulp with an epoxide-amine-polyamide reaction product, comprising the steps of adding to the pulp fiber suspension (A) an amount effective to enhance the sizing effect of component of a water soluble, direct, sulfonic acid-containing azo dye or a water-soluble, sulfonic acid-containing optical brightener of the distyrylbiphenyl or bistriazinylaminostilbene classes, followed by (B) an effective amount of a water-soluble or water-dispersible salt of an epoxide-amine-polyamide reaction product of (a) 1.0 epoxide group equivalent of a polyglycidyl ether of 2,2-bis-(4'-hydroxyphenyl)-propane, (b) 0.4 to 0.6 amino group equivalent of at least one mono-fatty amine having 16 to 18 carbon atoms, and (c) 0.3 to 0.5 amino group equivalent of a polyalkylene aminopolyamide from (c') polymerised linoleic acid or linolenic acid and (c'') diethylenetriamine, triethylenetetramine or tetraethylenepentamine, in the form of an aqueous preparation which has a solids content of 25 to 35 percent by weight, and a pH value of 4 to 5 and further processing the fiber suspension into paper or into cardboard.

2. A process according to claim 1, in which the amount of component (A) added is 0.01 to 1 percent by weight, relative to the dry-fiber content of the fiber suspension.

3. A process according to claim 1, in which the component (B) added is a salt of an epoxide-amine-polyamide reaction product which is produced in a water-soluble, aliphatic alcohol and ether having 1 to 10 carbon atoms, as an inert solvent, from a polyglycidyl ether having an epoxide content of 5 to 5.5 equivalents per kg as component (a), and a mono-fatty amine and a polyalkyleneaminopolyamide each having an amino group content of 3 to 4 amino group equivalents per kg as components (b) and (c), respectively, component (B) being an aqueous preparation of the salt of the condensation product, the pH value of which preparation being adjusted to 4 to 5 by an alkanecarboxylic acid having 1 to 3 carbon atoms.

4. A process according to claim 1, in which the amount of component (B) added is 0.2 to 0.8 percent by weight, relative to the dry-fiber content of the fiber suspension.

5. A process according to claim 1, in which the component (A) is added 20 to 120 minutes before the fiber suspension reaches the breastbox of the paper machine, and the component (B) is added 10 to 120 seconds before the fiber suspension reaches the breastbox of the paper machine.

6. A process according to claim 1, in which the components (A) and (B) are added to a fiber suspension, the pH value of which is 6 to 8.

7. A process according to claim 1, in which the fiber suspension contains, as mineral filler, kaolin or calcium carbonate.

8. A process according to claim 1, in which the fiber suspension has a Schopper-Riegler freeness value of 30° to 50°.

9. A process according to claim 1, in which the fiber suspension contains sulfite pulp from the wood of conifers and sulfate pulp from beechwood.

10. The process of claim 9, wherein the fiber suspension further contains mechanical wood pulp.

* * * * *

UNITED STATES PATENT AND TRADEMARK OFFICE

CERTIFICATE OF CORRECTION

PATENT NO. : 4,200,489

DATED : April 29, 1980

INVENTOR(S) : Jugo Tlach, Klaus-Dieter Leifels and Werner Mischler

It is certified that error appears in the above-identified patent and that said Letters Patent are hereby corrected as shown below:

Column 7, claim 1, line 56 reads

" of component of a water soluble, direct, sulfonic"

should be
--of component (b) of a water soluble, direct, sulfonic--.

Signed and Sealed this

*Twenty-fifth* Day of *November 1980*

[SEAL]

*Attest:*

SIDNEY A. DIAMOND

*Attesting Officer*

*Commissioner of Patents and Trademarks*